US010610433B2

(12) United States Patent
Kelsey et al.

(10) Patent No.: US 10,610,433 B2
(45) Date of Patent: Apr. 7, 2020

(54) SWIVEL SEAT SYSTEM

(71) Applicants: Thomas E. Kelsey, Granger, IN (US); Donna D. Kelsey, Granger, IN (US)

(72) Inventors: Thomas E. Kelsey, Granger, IN (US); Donna D. Kelsey, Granger, IN (US)

( * ) Notice: Subject to any disclaimer, the term of this patent is extended or adjusted under 35 U.S.C. 154(b) by 0 days.

(21) Appl. No.: 15/968,660

(22) Filed: May 1, 2018

(65) Prior Publication Data

US 2018/0311098 A1 Nov. 1, 2018

Related U.S. Application Data

(60) Provisional application No. 62/492,820, filed on May 1, 2017.

(51) Int. Cl.

| | |
|---|---|
| ***A47C 3/18*** | (2006.01) |
| ***A61G 7/10*** | (2006.01) |
| ***A47C 3/20*** | (2006.01) |
| ***A47K 3/12*** | (2006.01) |

(52) U.S. Cl.

CPC ..... *A61G 7/1076* (2013.01); *A47C 3/18* (2013.01); *A47C 3/20* (2013.01); *A47K 3/122* (2013.01); *A61G 7/1003* (2013.01); *A61G 7/1005* (2013.01); *A61G 7/1059* (2013.01)

(58) Field of Classification Search

CPC .. A61G 7/1076; A61G 7/1003; A61G 7/1005; A61G 7/1059; A47C 3/18; A47C 3/20; A47K 3/122

See application file for complete search history.

(56) References Cited

U.S. PATENT DOCUMENTS

| | | | | | |
|---|---|---|---|---|---|
| 3,855,646 | A * | 12/1974 | Glickman | A47K 3/122 | 4/578.1 |
| 4,150,445 | A * | 4/1979 | Bailey | A47K 3/122 | 4/546 |
| 5,606,751 | A * | 3/1997 | Baker | A47K 3/122 | 4/560.1 |
| 5,615,422 | A * | 4/1997 | Gravel | A47K 3/122 | 4/579 |
| 6,226,810 | B1 * | 5/2001 | Weddendorf | A47K 3/122 | 4/447 |
| 6,240,577 | B1 * | 6/2001 | Worthy | A47K 3/122 | 297/217.1 |
| 7,310,837 | B2 * | 12/2007 | Reynolds | A47K 3/122 | 4/579 |

(Continued)

*Primary Examiner* — Philip F Gabler
(74) *Attorney, Agent, or Firm* — Keith A. Miller; Keith Miller Patent Law, PLLC

(57) ABSTRACT

A swivel seat system comprising a base assembly, further comprising at least one first leg extending downward from a base plate, at least one second leg extending downward from the base plate, and a clamp plate assembly; a swivel assembly attached to an upper surface of the base plate; and a seat attached to an upper surface of the swivel assembly. The clamp plate assembly further comprises a clamp plate, a gear, a shaft extending downwardly from a center bore of the gear, an elongated handle extending outwardly from the shaft, and a rack coupled to the clamp plate, wherein the gear engages the rack via a plurality of teeth on the gear. The clamp plate assembly is structured and arranged to slide linearly along the bottom surface of the base plate by rotating the elongated handle.

20 Claims, 4 Drawing Sheets

(56) References Cited

U.S. PATENT DOCUMENTS

| | | | | |
|---|---|---|---|---|
| 7,661,154 | B2 * | 2/2010 | Cheng | A47K 3/122 4/560.1 |
| 8,332,971 | B2 * | 12/2012 | Bennett | A47K 3/122 4/560.1 |
| 8,979,190 | B2 * | 3/2015 | Madrigal | A47B 83/02 297/161 |
| 9,468,573 | B2 * | 10/2016 | Edwards | A47K 3/003 |
| 9,895,029 | B2 * | 2/2018 | Chao | A47K 3/122 |
| 2011/0308005 | A1 * | 12/2011 | Smith | A47K 3/122 4/579 |

* cited by examiner

SWIVEL SEAT SYSTEM

CROSS REFERENCE TO RELATED APPLICATION

The present application is related to and claims the benefit under 35 U.S.C § 119(e) of the prior U.S. provisional application Ser. No. 62/492,820 filed May 1, 2017 entitled "Hot Tub Swivel Seat System", the contents of which are incorporated herein by this reference in their entirety, and are not admitted to be prior art with respect to the present invention by the mention in this cross-reference section.

FIELD OF THE INVENTION

The present invention relates generally to a seat system for use when getting in and out of a tub. More specifically, the present invention relates to a hot tub swivel seat system to allow a handicapped user to more easily get into and out of a hot tub, or similar high-walled tub.

BACKGROUND OF THE INVENTION

Commonly, hot tubs and both regular and garden bathtubs are used for handicapped persons for therapy. However, it can be difficult for handicapped persons to get into and out of a normal hot tub or various types of bathtubs due to the high walls of the tub enclosure. Also, typical bathtubs are getting deeper with a great difference between the ground outside the bathtub and the bottom of the bathtub itself. In a similar vein, hot tubs typically sit on the ground and have very high walls to allow a person to fully submerge. An individual who may require a wheelchair, a walker, or other assist device to facilitate movement may find it difficult to enter or exit a bathtub or hot tub. Various types of seating devices assist and support individuals within a bathtub or shower, but not a hot tub.

Some bathtub seating devices take the form of a bench that is positioned between the sidewalls of the bathtub. These benches may be supported by a plurality of legs extending to a bottom of a bathtub. Such benches provide a seating surface on which an individual may be placed. Some bench type seats are designed to be more simply supported on the top of the sidewalls of the bathtub and may include devices for engaging opposing sidewalls of the bathtub.

To facilitate the manner in which an individual may be positioned on a bath chair or seat, other types of bench supports may include a portion that is either mounted directly over a sidewall of the bathtub or cantilevered outwardly therefrom to provide initial support for an individual being assisted. By initially seating an individual on a cantilevered seat, the individual may thereafter be moved so that his or her legs are brought inwardly to the bathtub while their weight is supported by the seat thereafter. The individual may then be shifted along the bench within the confines of the bathtub.

Some types of prior art structures are permanently installed adjacent the bathtub or hot tub enclosure. Other types of portable seating devices are supported both along the bottom of the bathtub and by an adjacent floor structure.

Accordingly, there exists a need for a more efficient way to allow a handicapped or disabled person to carefully enter into and out of a bathtub or hot tub with different levels of floor surfaces inside and outside the tub enclosure.

SUMMARY OF INVENTION

The present invention relates generally to an apparatus for providing a swivel seat system for a handicapped individual to enter a high sidewall tub enclosure comprising a seat, a swivel assembly, and a base assembly. The base assembly further comprises at least one first leg extending downward from a base plate inside of the tub enclosure, at least one second leg extending downward from the base plate outside of the tub enclosure, and a clamp plate assembly on a bottom surface of the base plate.

The clamp plate assembly further comprises a clamp plate, a gear, a shaft extending downwardly from a center bore of the gear, an elongated handle extending outwardly from the shaft, and a rack coupled to the clamp plate. The gear engages the rack via a plurality of teeth on the gear to move the clamp plate linearly along the bottom surface of the base plate. The swivel assembly is attached to a top surface of the base plate and a seat is attached to a top surface of the swivel assembly. The clamp plate assembly is structured and arranged to slide linearly along the bottom surface of the base plate to engage an outside sidewall of the tub enclosure. The seat rotates on the swivel assembly.

DETAILED DESCRIPTION OF THE INVENTION

The following description is provided for purposes of explanation, but not limitation, of the present invention. Specific details set forth in the following embodiments provide for a thorough understanding of the present invention. However, it will be apparent to one skilled in the art that specific details described in the preferred embodiments are not limitations required to practice the present invention, and the present invention may be practiced in embodiments that depart from those described.

Figure 1:
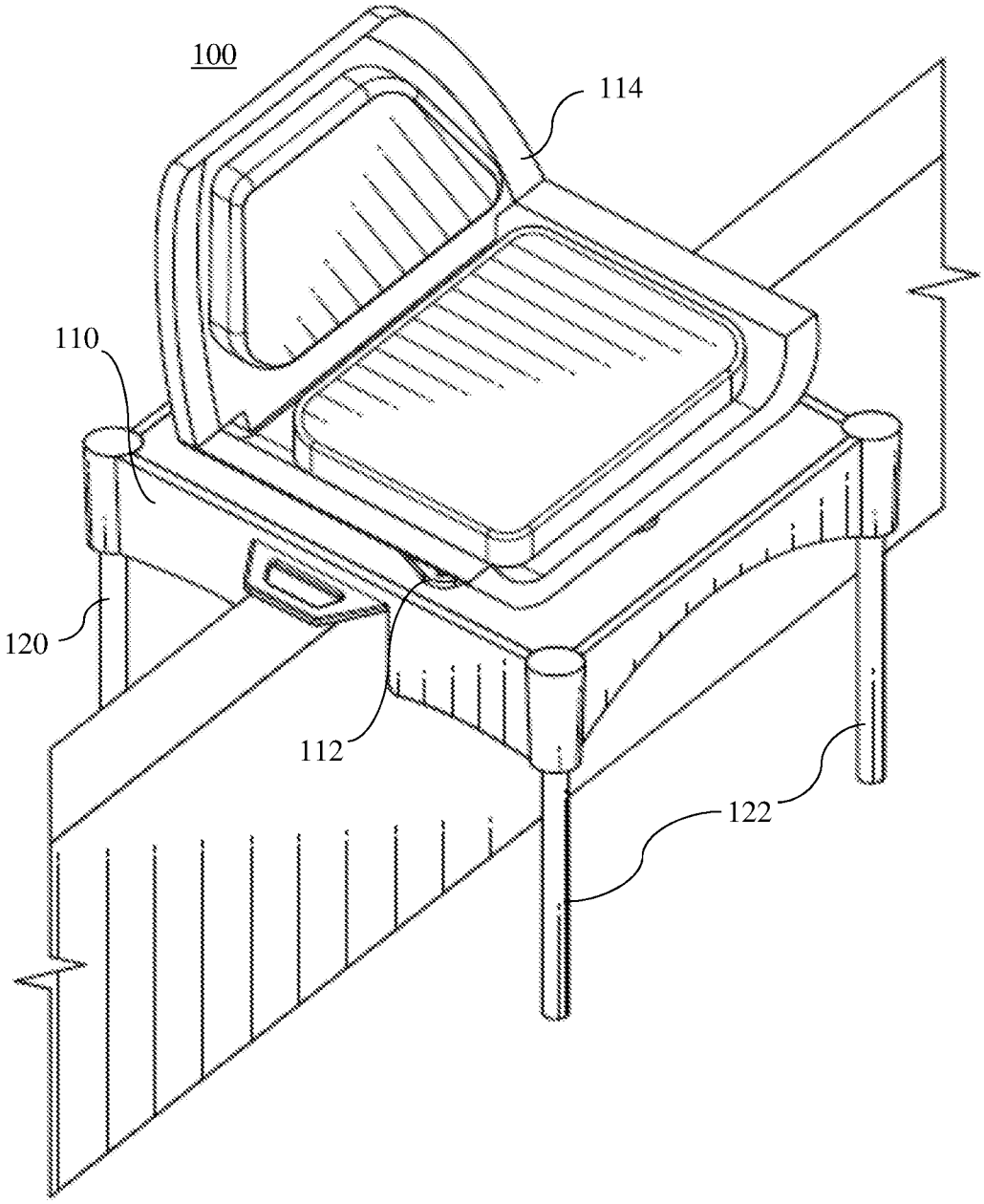
FIG. 1 is a perspective view of a Swivel Seat System according to the preferred embodiment of the present invention.

Now referring to the drawings, FIG. 1 shows a swivel seat system 100 configured to mount over and onto a sidewall of a tub-type enclosure such as a hot tub, bathtub, or other type of enclosure with a sidewall. The swivel seat system comprises a base assembly 110, a swivel assembly 112, and a seat 114. The seat 114 is attached to a top surface of the swivel assembly 112, and the swivel assembly is attached to a top surface of the base assembly 110. The base assembly 110 further comprises at least one first leg 120 extending downward from a base plate 126, at least one second leg 122 extending downward from said base plate 126, and a clamp plate assembly 140.

As further shown in FIG. 1, the base plate 126 is configured to sit on and mount to a top of the sidewall of a tub enclosure. In an embodiment, a vertical face 128 of a rear edge of the base plate facing inside the tub enclosure and a front edge of the base plate facing outside the tub enclosure. The at least one first leg 120 is preferably configured to extend downwardly from the rear edge of the base plate 126 to secure the swivel seat system 100 inside the tub enclosure.

The at least one second leg 122 is preferably configured to extend downwardly from the front edge of the base plate to secure the swivel seat from outside the enclosure.

The at least one first leg 120 is preferably adjustable in length from one foot in length to over four feet in length. Additionally, the at least one second leg 122 is preferably adjustable from one foot in length to over four feet in length.

Figure 2:
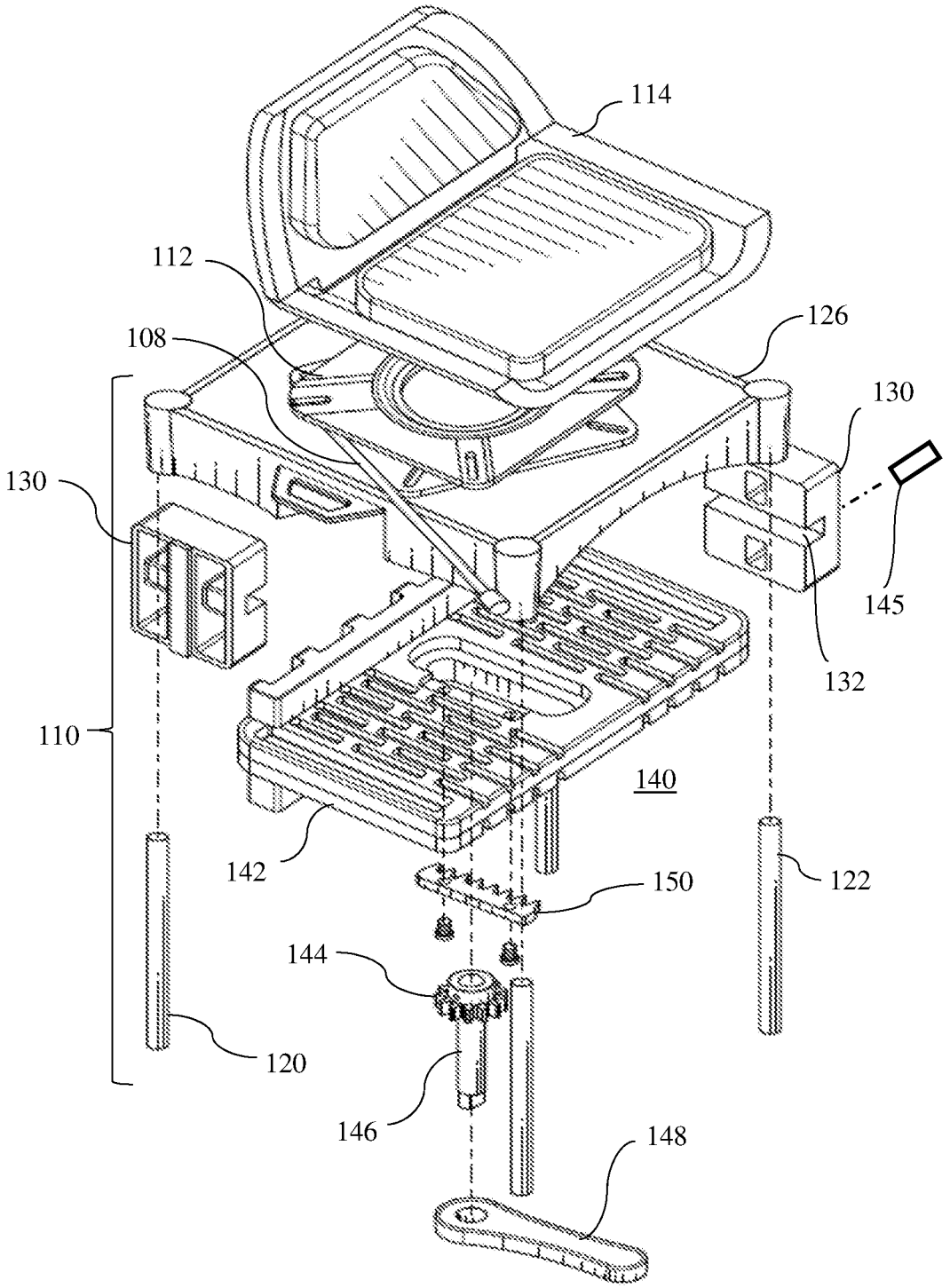
FIG. 2 is an exploded perspective view of the Swivel Seat System according to the preferred embodiment of the present invention.

As shown in FIG. 2, the bottom surface of the base plate 126 is preferably configured to have a rear section 128 of the base plate extend further downward creating a vertical face which preferably contacts a tub enclosure inner sidewall. The bottom surface of the base plate and the vertical face are preferably covered with a padding material, such as neoprene, or other waterproof padding material.

As further shown in FIG. 2, the bottom surface of the base plate 126 preferably further comprises a pair of clamp rails 130 extending downward from the base plate 126 and preferably located on a front corner of the base plate. Alternately preferably, the base plate extension is a separate block that is removably attached to the bottom surface of the base plate 126.

Figure 3:
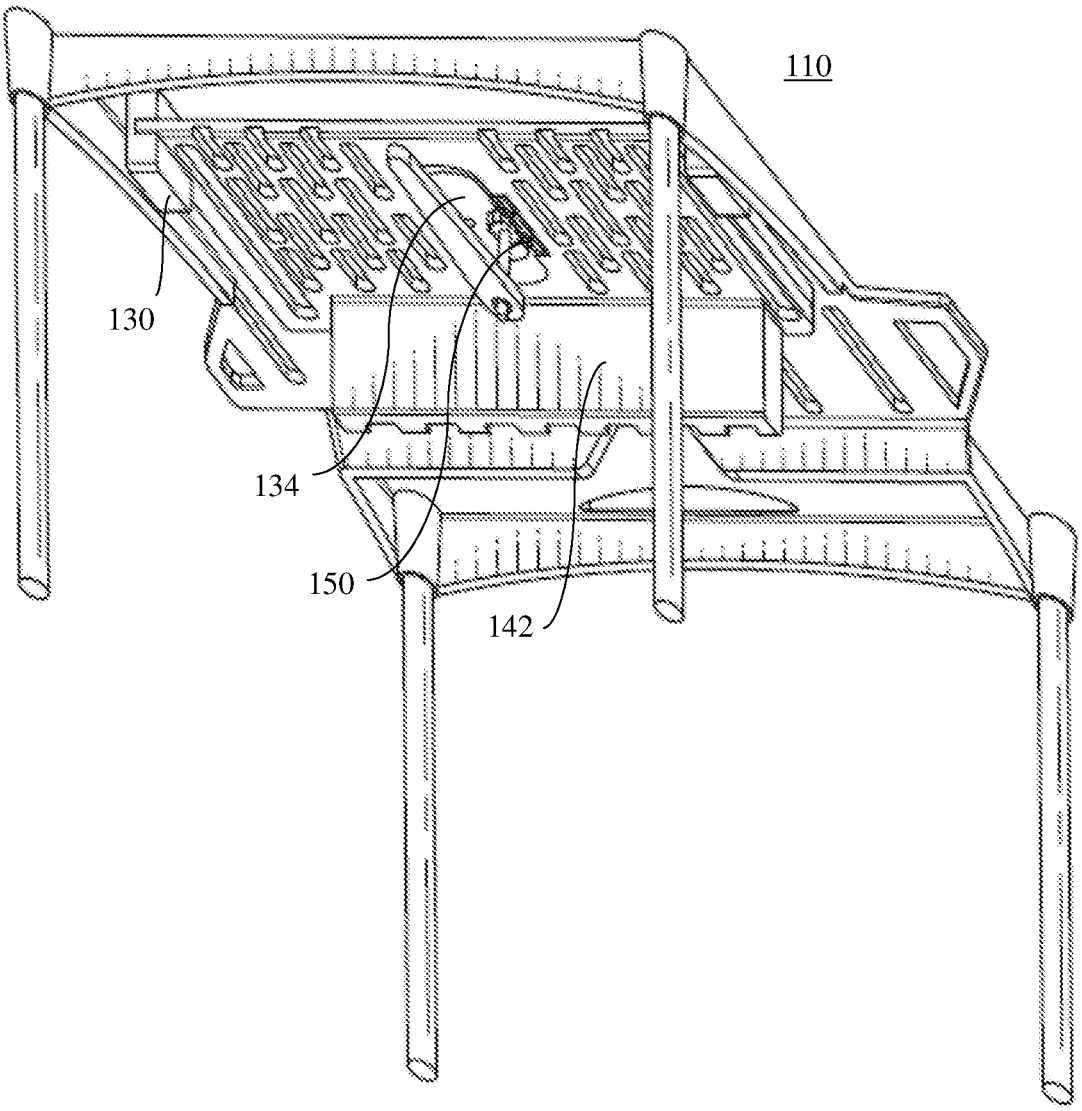
FIG. 3 is a perspective view of a base assembly of the Swivel Seat System according to the preferred embodiment of the present invention.

As further shown in FIGS. 2 and 3, the clamp plate assembly 140 is preferably further comprised of a clamp plate 142, a gear 144, a shaft 146 extending downwardly from a center bore of said gear, an elongated handle 148 extending outwardly from said shaft, and a rack 150 coupled to the clamp plate 142. The gear 144 preferably engages the rack 150 through a plurality of teeth on the gear. Moving the elongated handle 148 preferably rotates the gear 144 which moves the clamp plate 142 linearly to preferably engage an outside vertical surface of the tub enclosure sidewall. In an embodiment, the clamp plate assembly may include at least one retention device 145, to lock the clamp plate against a sidewall of the tube enclosure. As shown in FIG. 2, the swivel seat system further includes a swivel handle 108 configured to allow a user to move the swivel seat in a clockwise or counter clockwise direction.

Figure 4:
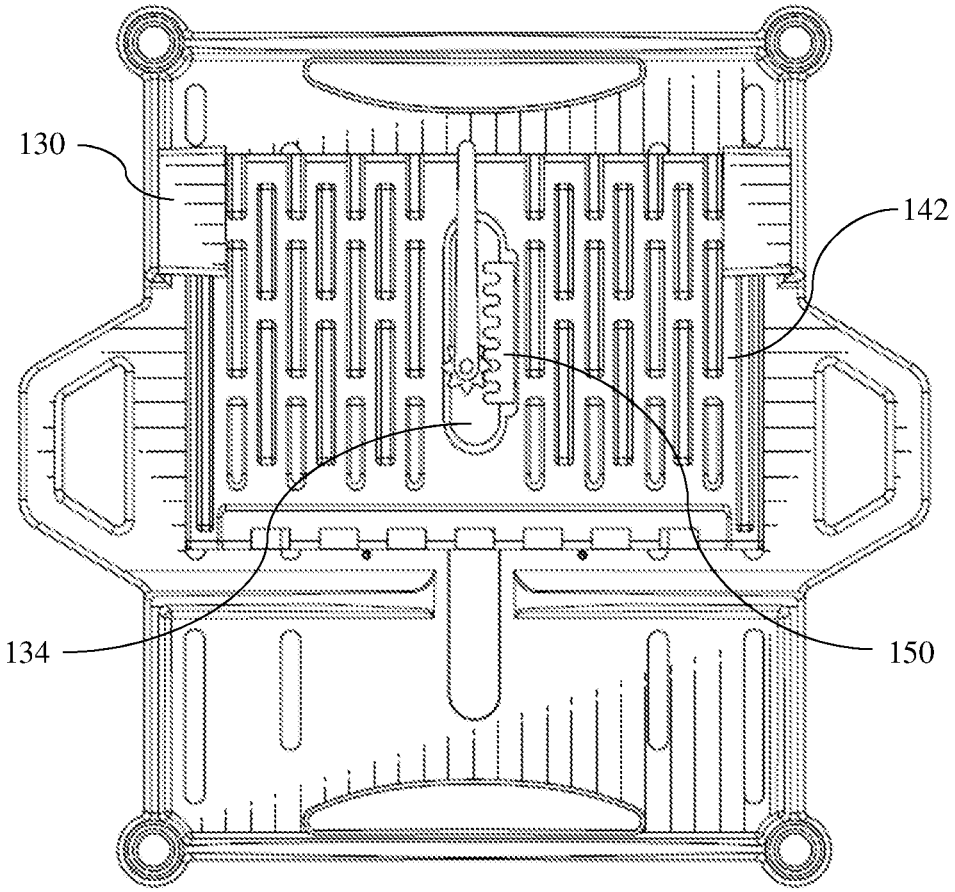
FIG. 4 is a detail bottom view of the base assembly for the Swivel Seat System according to the preferred embodiment of the present invention.

As further shown in FIGS. 3 and 4, the clamp rails 130 preferably further comprise at least one horizontal slot 132 configured to accept the clamp plate 142 and preferably allow the clamp plate to move linearly within said clamp rails 130. Alternately preferably, the pair of clamp rails 130 are individual blocks which are removably attached to the bottom surface of the base plate 126 at the two front corners. The pair of clamp rails 130 would be attached such that the at least one horizontal slot 132 for the pair of clamp plates face inwards toward each other. The rack 150 is preferably positioned along one side within an elongated hole 134 through the center of the clamp plate (FIG. 4), where the gear fits within the elongated hole 134 of the clamp plate.

A method of entering and exiting a tub enclosure, comprising the steps of: placing a swivel seat assembly on top of a sidewall of said tub enclosure; rotating an elongated handle to linearly move a clamp plate against said sidewall of said tub enclosure; extending at least one first leg downward to a bottom surface inside said tub enclosure; extending at least one second leg downward to a ground surface outside said tub enclosure; loading a user into a seat from a first position; rotating said seat with said user to a second position; and unloading said user into said tub enclosure.

The first position of the seat would be where the user's feet are positioned outside the tub enclosure. When rotating the seat on a swivel assembly, the user, or a helper, would raise their legs over the sidewall of the tub enclosure.

In an alternate embodiment, the clamp plate further comprises at least one retention device structured to hold the clamp plate in place against the side of the sidewall. The at least one retention device is preferably a pin extending from the clamp plate into a bottom surface of the base plate.

We claim:

1. A swivel seat system configured to clamp to a tub enclosure, the swivel seat system comprising:

a base assembly comprising a base plate, at least one first leg, at least one second leg, and a clamp plate assembly, wherein the at least one first leg is configured to extend downward from the base plate to an inside surface of the tub enclosure and the at least one second leg is configured to extend downward from the base plate to an independent surface outside of the tub enclosure;

a swivel assembly attached to an upper surface of the base plate; and a seat attached to an upper surface of the swivel assembly;

wherein the clamp plate assembly comprises a clamp plate, a gear, a shaft extending downward from a center bore of the gear, an elongated handle extending outward from the shaft, and a rack coupled to the clamp plate, wherein the gear is configured to engage the rack via a plurality of teeth on the gear;

wherein a rear section of a bottom surface of the base plate extends downward to form a first vertical face;

wherein second and third vertical faces extend downward from the bottom surface of the base plate and face inwards toward each other;

wherein the clamp plate assembly is configured to slide linearly within opposing, horizontal slots disposed in the second and third vertical faces and along the bottom surface of the base plate when a user rotates the elongated handle; and wherein the base plate and the clamp plate are configured to be positioned on opposite side of a sidewall of the tub enclosure.

2. The swivel seat system of claim 1, wherein the at least one first leg and the at least one second leg are adjustable in length.

3. The swivel seat system of claim 2, wherein the at least one first leg and the at least one second leg are each adjustable in length from approximately one foot to four feet.

4. The swivel seat system of claim 1, wherein the base plate further comprises a pad on the bottom surface.

5. The swivel seat system of claim 4, wherein the pad comprises neoprene rubber.

6. The swivel seat system of claim 1, wherein the clamp plate assembly further comprises at least one retention device configured to lock the clamp plate in position and prevent the clamp plate from sliding further along the bottom surface of the base plate.

7. The swivel seat system of claim 1, wherein the clamp plate is configured to include a fourth vertical face such that a sidewall of the tub enclosure is held in place between the base plate and the clamp plate.

8. The swivel seat system of claim 1, further comprising a swivel handle configured to allow a user to move the seat in a clockwise or counter clockwise direction.

9. The swivel seat system of claim 1, wherein the second and third vertical faces are removably attached to the bottom surface of the base plate.

10. The swivel seat system of claim 1, wherein the tub enclosure is a hot tub.

11. A swivel seat system for a tub enclosure comprising:

a base assembly comprising a base plate, at least one first leg, at least one second leg, and a clamp plate assembly, wherein the at least one first leg is configured to extend downward to an inside surface of the tub enclosure and the at least one second leg is configured to extend downward from the base plate to an independent surface outside of the tub enclosure;

a swivel assembly attached to an upper surface of the base plate; and a seat attached to an upper surface of the swivel assembly;

wherein the clamp plate assembly comprises a clamp plate, a sprocket, a shaft extending downward from a center of the sprocket, an elongated handle extending outward from the shaft, and a rack coupled to the clamp plate, wherein the sprocket is configured to engage the rack via a plurality of teeth on the sprocket;

wherein a bottom surface of the base plate extends downward to form a first vertical face along a rear edge of the base plate;

wherein second and third opposing vertical faces extend downward from the bottom surface of the base plate on a front edge of the base plate; and wherein the clamp plate assembly is structured and arranged to slide linearly within opposing, horizontal slots disposed in the second and third opposing vertical faces and along the bottom surface of the base plate when a user rotates the elongated handle.

12. The swivel seat system of claim 11, wherein the at least one first leg and the at least one second leg are adjustable in length.

13. The swivel seat system of claim 12, wherein the at least one first leg and the at least one second leg are each adjustable in length from approximately one foot to four feet.

14. The swivel seat system of claim 11, wherein the base plate further comprises a pad on the bottom surface.

15. The swivel seat system of claim 14, wherein the pad comprises neoprene rubber.

16. The swivel seat system of claim 11, wherein the clamp plate assembly further comprises at least one retention device configured to lock the clamp plate against a sidewall of the tub enclosure.

17. The swivel seat system of claim 11, wherein the clamp plate is configured to include a fourth vertical face such that a sidewall of the tub enclosure is held in place between the base plate and the clamp plate.

18. The swivel seat system of claim 17, wherein the sidewall of the tub enclosure is positioned between the first vertical face of the base plate and the fourth vertical face of the clamp plate.

19. The swivel seat system of claim 11, further comprising a swivel handle configured to allow a user to move the seat in a clockwise or counter clockwise direction.

20. The swivel seat system of claim 11, wherein the second and third opposing vertical faces are removably attached to the bottom surface of the base plate.

* * * * *